United States Patent [19]

Stauffer et al.

[11] 4,181,578

[45] Jan. 1, 1980

[54] LEVELING BAR FOR COKE OVENS

[75] Inventors: Donald R. Stauffer, Baltimore; Rolf Stuenes, Dundalk, both of Md.

[73] Assignee: Bethlehem Steel Corporation, Bethlehem, Pa.

[21] Appl. No.: 947,138

[22] Filed: Sep. 29, 1978

[51] Int. Cl.[2] ..... C10B 37/02; C10B 31/00

[52] U.S. Cl. ..... 202/239; 202/262; 202/270; 414/198

[58] Field of Search ..... 201/40; 202/262, 269, 202/270, 239; 214/23

[56] References Cited

U.S. PATENT DOCUMENTS

| | | | |
|---|---|---|---|
| 1,105,522 | 7/1914 | Koppers | 202/262 X |
| 1,720,805 | 7/1929 | Van Ackeren et al. | 214/23 |
| 1,937,734 | 12/1933 | Underwood | 214/23 |
| 2,290,568 | 7/1942 | McIntosh | 202/270 |
| 3,207,334 | 9/1965 | Becker | 202/270 X |
| 3,616,947 | 11/1971 | Tucker | 214/23 |

FOREIGN PATENT DOCUMENTS

| | | | |
|---|---|---|---|
| 902725 | 1/1954 | Fed. Rep. of Germany | 214/23 |
| 902842 | 1/1954 | Fed. Rep. of Germany | 214/23 |
| 1075918 | 4/1954 | France | 214/23 |
| 732215 | 6/1955 | United Kingdom | 214/23 |

*Primary Examiner*—Joseph Scovronek
*Assistant Examiner*—Roger F. Phillips
*Attorney, Agent, or Firm*—Joseph J. O'Keefe; John J. Selko

[57] ABSTRACT

A coke oven leveling bar is provided with downwardly tapered side members and cross plates to form a plurality of coal receiving pockets having a bottom opening larger than a top opening to minimize arching of coal within the coal receiving pockets.

9 Claims, 7 Drawing Figures

LEVELING BAR FOR COKE OVENS

BACKGROUND OF THE INVENTION

In the charging of crushed coal into horizontal, slot-type coke ovens, the coal charged therein forms peaks beneath each charging hole with valleys between the peaks. For uniform coking and effective flow of volatile gas within the coke oven during the coking process, it is necessary to level out the peaks and valleys. Such leveling is performed with a reciprocating leveling bar which usually has side members and cross plates therebetween to form coal receiving pockets having a top and botton opening. The leveling bar is carried on a mobile pushing machine which is equipped to insert the leveling bar into the coke oven and to reciprocate the leveling bar therein. As the leveling bar reciprocates in the coke oven, the coal receiving pockets fill with coal from the peaks and deposit the coal by gravity into the valleys, by discharging such coal out a bottom opening, as a coal receiving pocket passes over a valley.

Frequently, particularly with coal having a high moisture content, the coal receiving pockets become clogged due to arching of coal therein caused by coal adhering to the surfaces which define the coal receiving pockets. Arching of coal is referred to herein as a condition wherein the coal in the pocket does not rapidly flow out the bottom opening of a coal receiving pocket into a valley below due to such adherence. In extreme cases, coal does not flow out of a coal receiving pocket at all.

When the coal receiving pockets become clogged, the efficiency of the leveling bar decreases, requiring more time to complete the leveling operation, thereby undesirably prolonging the charging process. In addition, occasionally the coal may not flow from the clogged pockets until the leveling bar is removed from the oven, and the coal may then fall onto the pushing machine, resulting in reduced coke production and extra cleanup effort.

There is a need, therefore, for a highly efficient leveling bar which minimizes arching of coal within the coal-receiving pockets.

SUMMARY OF THE INVENTION

The present invention satisfies the above-mentioned need by providing a leveling bar with a pair of longitudinally extending side members having inner side surfaces upwardly inclined toward each other and cross plates therebetween wherein such side members and cross plates form a plurality of coal receiving pockets having a bottom opening larger than a top opening to minimize arching of coal therein. The cross plates can have front and back surface which are vertical or upwardly inclined.

DESCRIPTION OF THE PREFERRED EMBODIMENT

Figures 1, 2, 3:
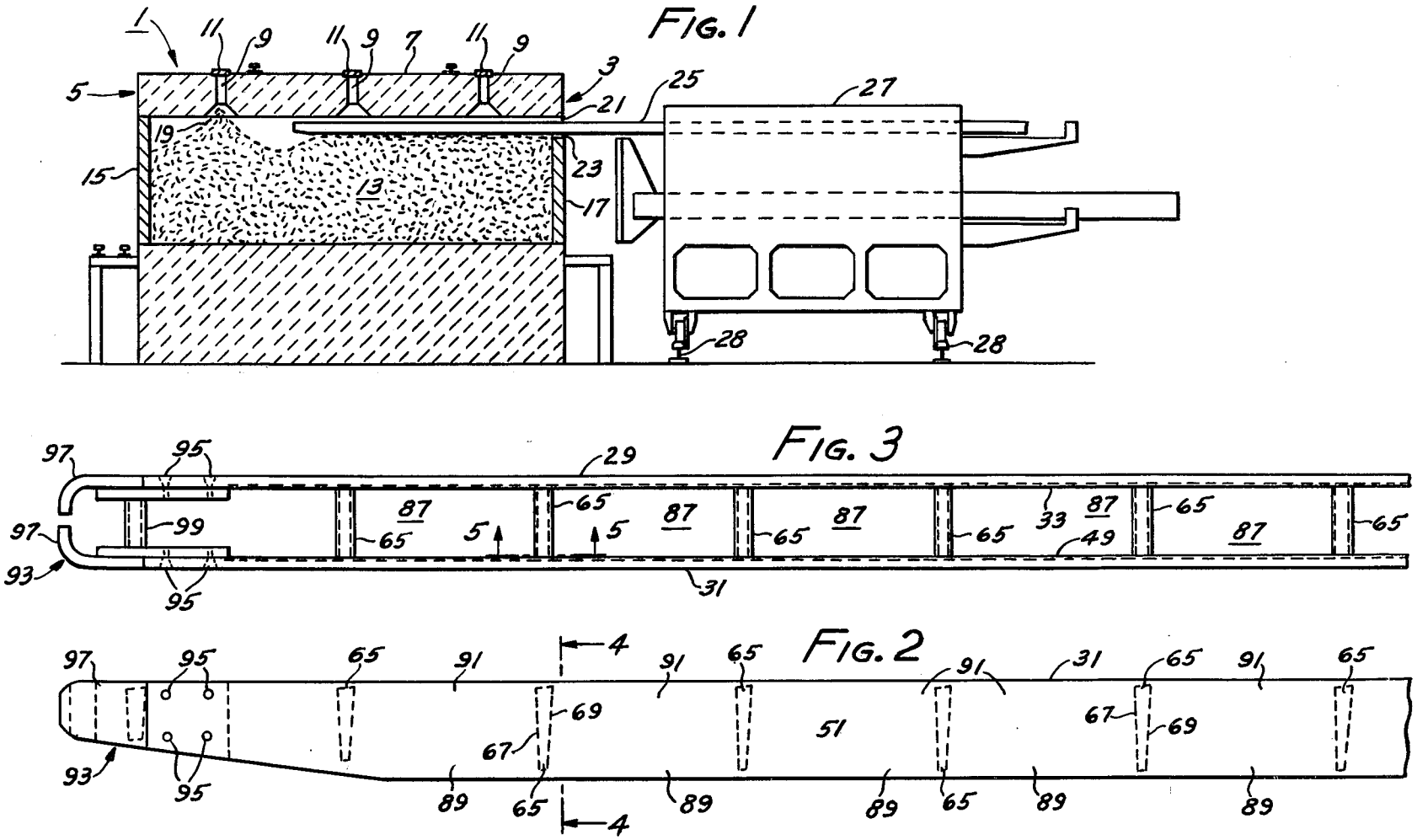
FIG. 1 is a view in side elevation of a coke oven battery in section through a coke oven illustrating the leveling bar and pushing machine.
FIG. 2 is a view in side elevation of the leveling bar front end portion.
FIG. 3 is a top plan view of the leveling bar front end portion.

Referring to FIG. 1, there is illustrated in Section, a coke oven battery, generally designated by the numeral 1, which battery has a pusher side 3, coke side 5 and roof 7 having charging holes 9 therein. Suitable closure means 11 close charging holes 9, after charging is complete. The sectional view of FIG. 1 is taken through a coke oven showing the coal charge 13 therein. Doors 15 and 17 close the ends of the coke oven.

Coal is charged through charging holes 9 from a larry car (not shown), and forms peaks beneath charging holes 9 similar to the peak 19. In the coke oven door 17 and just below the roof top 21 on the pusher side of the oven is a leveling bar opening 23 referred to as a chuck door.

The leveling bar 25 is arranged to be inserted into the coke oven through chuck door 23 and moved reciprocally within the coke oven to level the piles of coal. Suitable sealing means (not shown) surround the leveling bar to seal the openings between the chuck door frame and leveling bar to prevent emissions. After the coal is leveled, the leveling bar is removed, the chuck door closed, and the coking process initiated.

The leveling bar 25 is carried by a pushing machine 27 mounted on rails 28 for movement longitudinally along the battery. The pushing machine 27 carries suitable apparatus for opening and closing the chuck door 23, and for supporting and moving leveling bar 25 into and out of the coke oven, as well as for reciprocation therein. The above features are conventional and form no part of the invention.

Figure 4:
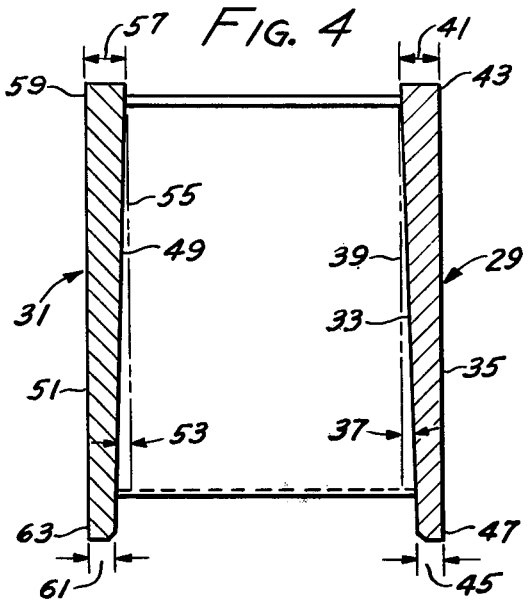
FIG. 4 is a view in elevation taken along lines 4—4 of FIG. 2.

Referring to FIGS. 2, 3, and 4, the leveling bar 25 includes upstanding, longitudinally extending, downwardly tapered side members 29 and 31 spaced in substantially parallel relation.

Side member 29 has a first inner side surface 33 upwardly inclined, as an outer side surface 35 shown substantially vertical, or not inclined. First inner side surface 33 forms an angle 37 with a vertical plane 39 as shown in FIG. 4. Therefore, in describing side member 29 as downwardly tapered, we mean first inner side surface 33 is upwardly inclined away from outer side surface 35 such that the thickness 41 at the upper end 43 of side member 29 is greater than the thickness 45 at the lower end 47 of side member 29.

Likewise side member 31 has a second inner side surface 49 upwardly inclined, and an outer side surface 51, shown substantially vertical, or not inclined. Second inner side surface 49 forms an angle 53 with a vertical plane 55, as shown in FIG. 4. In describing side member 31 as downwardly tapered, we mean second inner side surface 49 is upwardly inclined away from outer side surface 51 such that the thickness 57 at the upper end 59 of side member 31 is greater than the thickness 61 at the lower end 63 of side member 31.

First and second inner side surfaces 33 and 49 are spaced in opposed facing relationship such that first and second side surfaces 33 and 49 are upwardly inclined toward each other. The upward inclination of inner side surfaces 33 and 49 tends to prevent moist crushed coal from adhering thereto during leveling, and therefore helps to minimize arching of such coal. Side members 29 and 31 can be downwardly tapered by suitable machining of an elongated plate.

As an alternate embodiment, side members 29 and 31 can be provided with inner side surfaces 33 and 49 parallel to outer side surfaces 35 and 51 respectively, and inner side surfaces 33 and 49 can be inclined toward each other by tilting side members 29 and 31 toward each other. In this event, the outer side surfaces 35 and 51 will also be inclined toward each other, and obvious adjustments may have to be made in the chuck door sealing mechanism which closes the gap between the chuck door frame and outer side surfaces 35 and 51 when leveling bar 25 is within the coke oven. We prefer to provide the downward taper to side members 29 and 31 by inclining only inner side surfaces 33 and 49.

While we have shown inner side surfaces 33 and 49 tapered at the same angle with respect to a vertical plane 39, the angles 37 and 53 do not have to be equal. Also, while we have shown inner side surfaces 33 and 49 as substantially planar, such surfaces can also be somewhat arcuate, or curved.

Referring to FIGS. 2 and 3, a plurality of upstanding cross plates 65 extend transversely between side members 29 and 31. Cross plates 65 are rigidly fixed to side members 29 and 31 as by welding.

Figure 5:
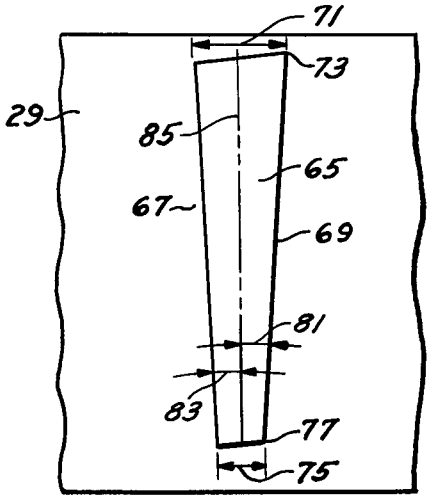
FIG. 5 is an enlarged view in elevation taken along lines 5—5 of FIG. 3.

Referring to FIG. 5, each cross plate 65 is shown downwardly tapered. By downwardly tapered, we mean cross plate 65 has a front surface 67 and back surface 69 both inclined upwardly from each other, so that the thickness 71 at upper end 73 is greater than the thickness 75 at lower end 77. The upward inclination of front and back surfaces 67 and 69 tends to prevent moist crushed coal from adhering thereto during leveling, and therefore helps to minimize arching of such coal. Again we prefer to taper cross plate 65 by suitable machining. The upper end 73 and lower end 77 of each cross plate extends to within a short distance below and above the upper and lower ends 43, 47, 59 and 63 respectively, of side members 29 and 31. While cross plates 65 are shown substantially perpendicular to side members 29 and 31, it would be equivalent to place cross plates 65 somewhat at a diagonal to side members 29 and 31.

While we have shown front surface 67 and back surface 69 of cross plates 65 both inclined upwardly away from each other at the same angle 81 and 83 with respect to a plane 85 through the midpoint of cross plate 65 the angles 81 and 83 do not have to be equal. Also, while we have shown front and back surfaces 67 and 69 as substantially planar, such surfaces can also be somewhat arcuate, or curved. Only one surface, i.e. a front surface 67 need be inclined upwardly away from the back surface 69, while the back surface 69 may be vertical. It should be understood that we have identified surfaces 67 and 69 as front and back respectively for reference only, and that surfaces 67 and 69 could be identified in reverse, as back and front respectively.

As can be understood from the foregoing, each pair of cross plates 65 and side members 29 and 31 therebetween form a coal-receiving pocket 87 having a bottom opening 89 larger than its top opening 91, thereby minimizing arching of coal within pocket 87, which arching is caused by moisture bearing crushed coal tending to stick to first or second side surfaces 33 and 49 or front and back surfaces 67 and 69. Also, each pair of side members 29 and 31 and cross plates 65 therebetween form a plurality of coal receiving pockets 87 having a bottom opening 89 and top opening 91 with bottom opening 89 larger than top opening 91.

Thus, the combination of side members 29 and 31 and plurality of cross plates 65 provide a leveling bar 25 having a plurality of coal receiving pockets 87 with a bottom opening 87 larger than a top opening 91.

Figure 7:
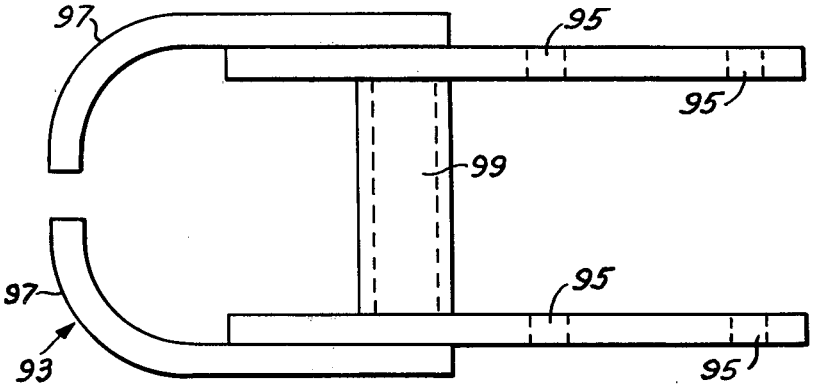
FIG. 7 is a top plan view of the leveling bar head.
Figure 6:
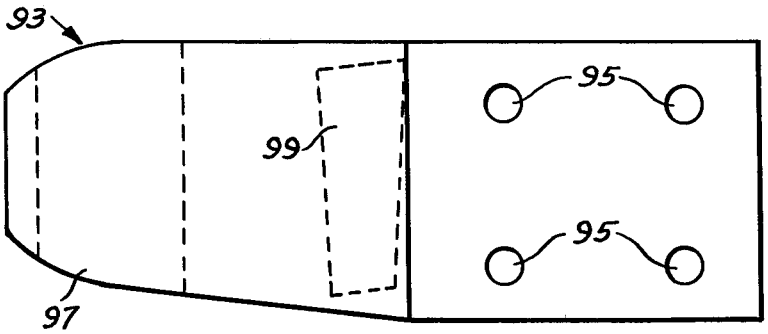
FIG. 6 is a view in side elevation of the leveling bar head.

As shown in FIGS. 2, 6, and 7, side members 29 and 31 decrease somewhat in height at the front end of leveling bar 25 and terminate in a leveling bar head means 93 fastened thereto as by bolts at 95. Leveling bar head 93 includes forward extending prongs 97 and a downwardly tapered cross plate 99. As is well known, leveling bar head means 93 first contacts the coal in the coke oven during leveling.

As an alternate embodiment, it would be possible to provide only one side member 29 with an upwardly inclined inner side surface 33 and the other side member 31 with a substantially vertical inner side surface 49. In combination with such side members a plurality of cross plates 65 each can have both front and back surfaces 67 and 69 vertical or only one surface, i.e. front surface 67 upwardly inclined away from vertical back surface 69. Also in combination with such side members, a plurality of cross plates 65 each can have both front and back surfaces 67 and 69 inclined upwardly away from each other, i.e. be downwardly tapered.

As a further embodiment, inner side surfaces 31 and 49 can be vertical, with a plurality of cross plates 65 having only one surface, i.e. front surface 67, upwardly inclined away from a vertical back surface 69, or a plurality of cross plates 65 can have both front and back surface 67 and 69 inclined upwardly away from each other, i.e. be downwardly tapered.

Any combination of upwardly inclined inner surfaces 33 and 49 and upwardly inclined front and back surfaces 67 and 69 can be provided, so long as such combination of surfaces provides a plurality of coal receiving pockets 87 having a top and bottom opening, 91 and 89 with each bottom opening 89 larger than the top opening 91 spaced above.

For maximum efficiency, we prefer to provide inner side surfaces 33 and 49 and front and back surfaces 67 and 69 each upwardly inclined. The preferred embodiment has been utilized in practice and showed a significant improvement over prior art leveling bars, due to minimized arching of coal.

We prefer to make downwardly tapered side members 29 and 31 10 inches (254 mm) high, with a thickness 41 and 57 at the upper end 43 and 59 of $\frac{7}{8}$ inch (22.2 mm) and a thickness 45 and 61 at the lower end 47 and 63 of $\frac{5}{8}$ inch (15.9 mm), with angles 37 and 53 6°37″. On downwardly tapered cross plates 65, we prefer to make angles 81 and 83 6°37″ with a thickness 71 at the upper end 73 of 2 inches (50.8 mm) and a thickness 75 at lower end 77 of 1 inch (25.4 mm).

The portion of the leveling bar 25 described above is that front portion which extends into the coke oven to perform the leveling. Rearward portions of the leveling bar which do not extend into the coke oven need not provide the coal receiving pockets as described above, but the rearward portion may be so provided, if desired.

We claim:

1. A leveling bar comprising:

(a) a first upstanding longitudinally extending side member having a first side surface;

(b) a second upstanding longitudinally extending side member having a second side surface;

(c) said first and second side surfaces in opposed facing relation, and said first side surface inclined upwardly toward said second side surface;

(d) a plurality of upstanding transversely extending cross plates between said first and said second side members each cross plate having a substantially vertical front and back surface;

(e) each pair of cross plates and side members therebetween forming a coal receiving pocket having a top and bottom opening, with said bottom opening larger than said top opening to minimize arching of coal within said pocket; and (f) a leveling head means on one end of said leveling bar for first contacting coal in a coke oven during leveling.

2. The invention of claim 1 in which said second side surface is inclined upwardly toward said first side surface.

3. The invention of claim 1 in which a plurality of said cross plates have a front surface inclined upwardly away from said back surface.

4. The invention of claim 2 in which a plurality of said cross plates have a front surface inclined upwardly away from said back surface.

5. The invention of claim 1 in which a plurality of said cross plates have a front and back surface both inclined upwardly away from each other.

6. The invention of claim 2 in which a plurality of said cross plates have a front and back surface both inclined upwardly away from each other.

7. A leveling bar comprising:

(a) a pair of longitudinally extending side members spaced in substantially parallel relation each side member having a substantially vertical inner side surface;

(b) a plurality of transversely extending cross plates between said side member, each cross plate having a front and back surface with said front surface inclined upwardly away from said back surface;

(c) said pair of side members and cross plates therebetween forming a plurality of coal receiving pockets having a top and bottom opening, with said bottom opening larger than said top opening to minimize arching of coal within said pocket; and (d) a leveling head means on one end of said leveling bar for first contacting coal in a coke oven during leveling.

8. The invention of claim 7 in which a plurality of cross plates have a front and back surface both inclined upwardly away from each other.

9. A leveling bar comprising:

(a) a pair of longitudinally extending downwardly tapered side members spaced in substantially parallel relation;

(b) a plurality of transversely extending downwardly tapered side plates between said side members;

(c) said tapered side members and tapered cross plates therebetween forming a plurality of coal receiving pockets having a top and bottom opening, with said bottom opening larger than said top opening, to minimize arching of coal within said pocket; and (d) a leveler head means on one end of said leveler bar for first contacting coal in a coke oven during leveling.

* * * * *